US006964594B2

(12) United States Patent
Kleinman

(10) Patent No.: US 6,964,594 B2
(45) Date of Patent: Nov. 15, 2005

(54) CELEBRITY FIGURINE

(76) Inventor: Kelly Kleinman, 955 Sandpiper Cir., Westlake Village, CA (US) 91361

( * ) Notice: Subject to any disclaimer, the term of this patent is extended or adjusted under 35 U.S.C. 154(b) by 0 days.

(21) Appl. No.: 10/712,230

(22) Filed: Nov. 13, 2003

(65) Prior Publication Data

US 2005/0170740 A1 Aug. 4, 2005

(51) Int. Cl.[7] ..... A63H 3/16

(52) U.S. Cl. ..... 446/97; 446/297

(58) Field of Search ..... 446/297, 299, 446/302, 303, 296, 391, 99–101; D21/576, D21/621, 625, 627, 634, 635, 639

(56) References Cited

U.S. PATENT DOCUMENTS

| | | | | | |
|---|---|---|---|---|---|
| 2,627,699 | A | * | 2/1953 | Schuettenhelm et al. | 446/297 |
| 5,224,896 | A | * | 7/1993 | Terzian | 446/355 |
| 5,515,592 | A | * | 5/1996 | Mills | 29/412 |
| 5,738,561 | A | * | 4/1998 | Pracas | 446/297 |
| 5,816,951 | A | * | 10/1998 | Hudock | 473/447 |
| 5,956,985 | A | * | 9/1999 | Chang | 70/456 R |

* cited by examiner

*Primary Examiner*—Bena Miller

(57) ABSTRACT

A three-dimensional sculptural celebrity figurine appears dressed in his or her uniform or costume and speaks a signature phrase for that celebrity. The celebrity figurine is molded from a pair of plastic shells forming a caricature and painted to display a uniform or costume. The figurine contains a voice recording stored on a chip.

2 Claims, 3 Drawing Sheets

CELEBRITY FIGURINE

DISCUSSION OF RELATED ART

Celebrity figurines are highly collectible and often traded among sports fans, movie lovers and fans of music. In the past, various celebrity figurines have featured caricatures of celebrities. More recently, the celebrity figurines include movable head figurines that simulate neck motion.

Making a celebrity figurine requires various molds and shapes for each celebrity figurine. Some inventors have attempted to modularize facial features in an attempt to offer a standardized set of facial features. U.S. Pat. No. 6,447,359 discloses modular interchangeable features for making a doll resembling a person, so that loved ones can remember their deceased. Unfortunately, modular features lack accuracy in representing the true character of a celebrity. Also, a celebrity figurine should be easily constructed, easily painted and durable enough to be carried casually.

DETAILED DESCRIPTION

Figure 1:
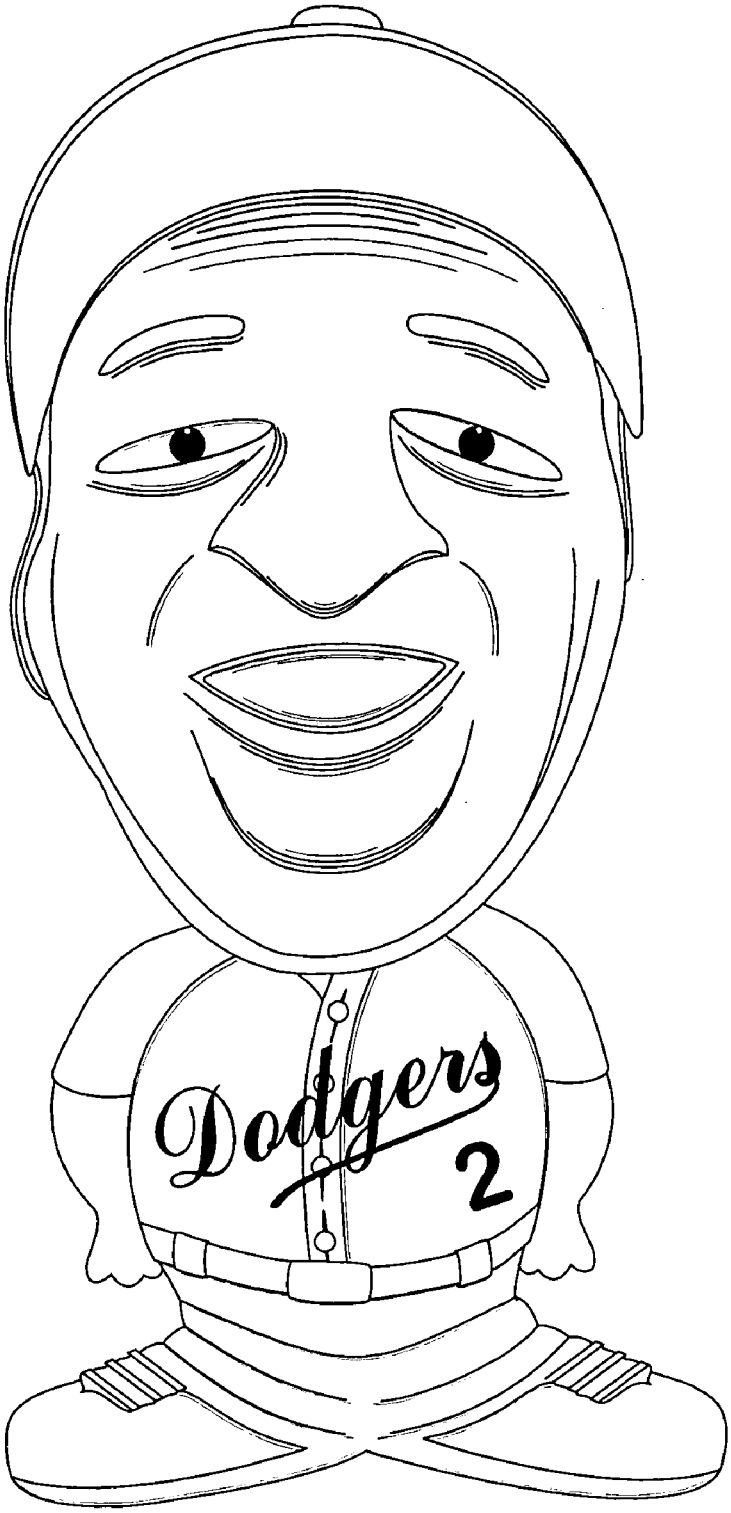
FIG. 1 is a front view of a celebrity doll.
Figure 2:
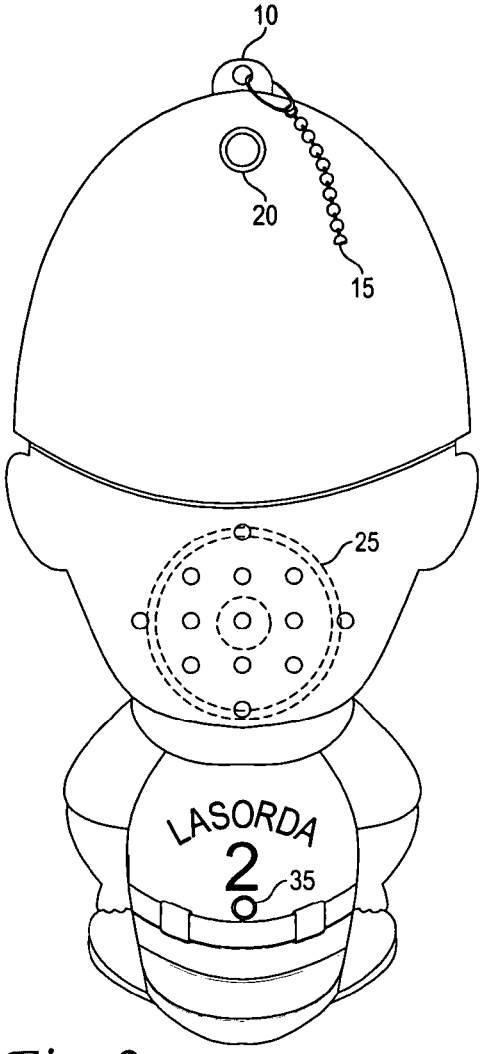
FIG. 2 a rear view of a celebrity doll.
Figure 3:
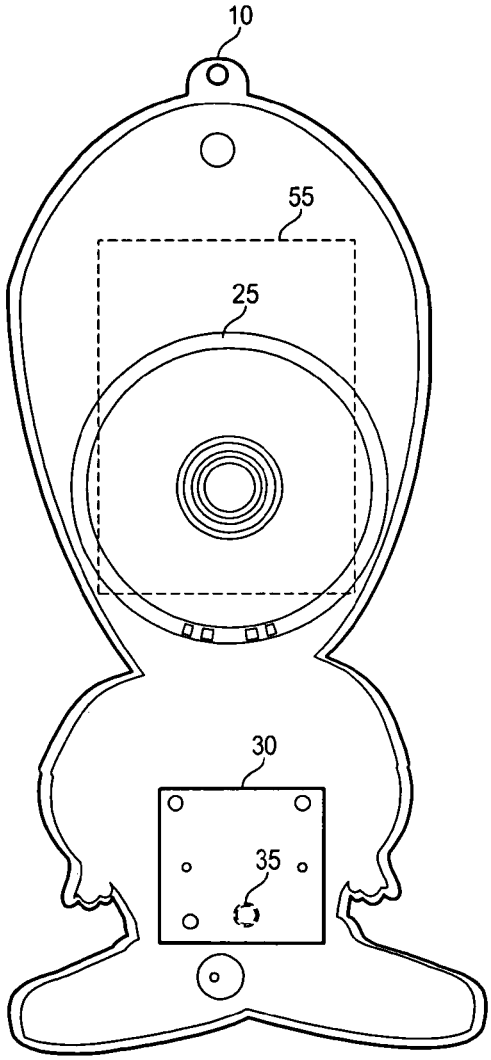
FIG. 3 shows the front view of the rear portion of the celebrity doll.
Figure 5:
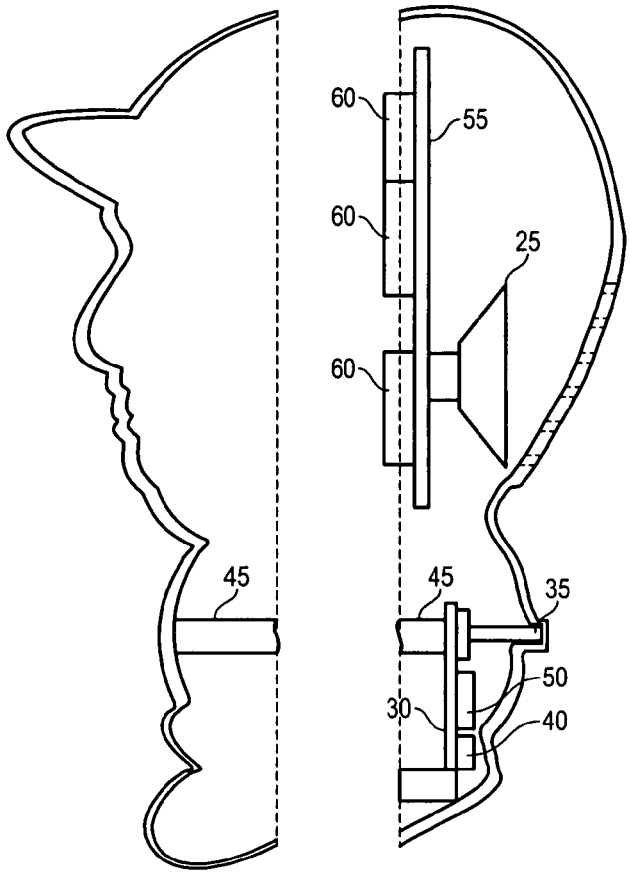
FIG. 5 shows an assembly side view.
Figure 4:
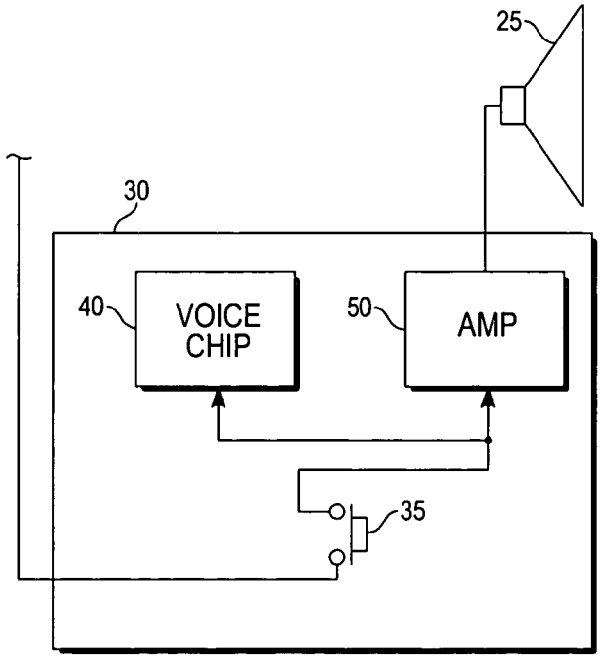
FIG. 4 shows a diagram of the electronics.

A three-dimensional sculptural celebrity figurine appears dressed in his or her uniform or costume and speaks a signature phrase for that celebrity. The celebrity figurine is molded from a pair of plastic shells forming a caricature and painted to display a uniform or costume. The figurine contains a voice recording stored on a chip. Figure one shows a celebrity figurine in the front view. The front view shows the front shell housing that is joined to a rear shell housing. Preferably, the joining of the pair of shell housings does not create an interface that crosses the front view such that it can be seen in the front view.

The celebrity can be a ball player or famous coach such as the world renowned Tommy Lasorda. A ball player or coach celebrity appears in his or her official uniform. The voice recording is the recording of a common saying of the celebrity. The celebrity may have a plurality of common sayings. The voice recordings of the celebrity can be randomized or sequenced for variety.

In the case of a movie character, the movie character celebrity appears in costume and speaks in his or her movie character voice. The costume or uniform is scaled so that the figurine maintains a larger head than body. Upon activation, the movie character speaks lines from the movie that the character appears in. The movie character preferably recites his or her common saying. In the case of a famous musical singer, the singer can sing one or more lines from a song.

Figure two shows a rear view of the celebrity doll. The celebrity doll optionally includes a key chain attachment means 15. The top of the figurine may include a connection for the key chain attachment means. The key chain attachment means 15 can also be used for hanging and displaying the celebrity figurine. The top of the figurine also includes a hole 20 threaded and allowing a screw to hold together the front and rear shell housings of the celebrity doll. The rear of the celebrity figurine includes a speaker grille comprised of a plurality of sound holes formed in the plastic shell of the rear shell. The speaker grill is placed in front of the speaker 25 allowing transmission of a clear voice while protecting and hiding the speaker 25. The rear of the celebrity figurine additionally includes a push button 35. The push button 35 electrically completes a circuit activating the speech electronics of the figurine. A push button switch mounted in the back of the back shell housing activates the electronic voice recording. The voice-recording chip can play one or more recordings through a speaker mounted in the internal module 55 and 30 circuit boards.

An electronic voice recording is stored on a solid state chip that is battery-powered. The internal module including the batteries, electronic voice-recording chip, speaker, and push button assembly is stored within the hollow portion of the rigid plastic pair of shell housings. The pair of shell housings includes a front shell housing and a back shell housing. The front housing shows the front of the celebrity, the rear housing shows the back of the celebrity.

Figure three shows the rear shell of the figurine. The key chain attachment means 10 can be formed as a loop of material, or a single tab having a hole in it. An upper circuit board 55 or a lower circuit board 30 can contain, a voice chip and other electronics. A supporting post 45 is built into the front shell protruding and supporting the lower circuit board so that a user pressing on the button 35 does not bias or move the lower circuit board 30.

Figure four shows a rudimentary partial circuit diagram having the speaker 25 powered by an amplifier signal source 50 and actuated by a push button switch 35 that activates a voice chip 40. The chip, switch and related components can be mounted on a lower circuit board 30. Although the separate amplifier signal is shown as a block, the separate amplifier can be a transistor or other integrated component that is not readily apparent from casual physical inspection.

Figure five shows an assembly diagram for the figure. When the pair of shell housings is closed it forms a figurine having an upper head portion that is larger than the lower body portion. Preferably, the push button switch is housed within the lower body portion. The push button protrudes from the rear of the lower body portion. Preferably, the speaker is housed within the rear upper head portion. The rear upper head portion is perforated with a plurality of holes allowing transmission of sound from the speaker. The speaker grille is carefully painted over with a design such as hair that would conceal the speaker grille. The front upper head portion houses the batteries and electronic voice chip. The top of the housing forming the top of the character head includes a loop where a user may attach a lanyard or key chain and hang the character.

The front and rear housing shells join together sandwiching the upper circuit board 55 and the lower circuit board 30. The upper circuit board 55 retains batteries 60. Preferably, the batteries include a trio of 1.5 volt batteries wired in series, but can also be a single battery. The best mode is to use three 1.5 voltage button batteries held in clips that are mounted on the circuit board. A user may remove the button batteries 60 and replace the button batteries individually. Using the button batteries, button battery clips hold the batteries in circuit with the remainder of the components mounted on the miniaturized circuit board. The speaker can also be mounted on the circuit board, or can be mounted against the rear portion of the rear shell housing.

An opening formed as a hole in the lower portion of the rear shell allows the push button to protrude from the lower portion of the rear shell. The push button is mounted so that a user can push the push button in the back of the character.

The foregoing describes the preferred embodiments of the invention and modifications may be made without departing from the spirit and scope of the invention as set forth in the following claims.

CALL OUT LIST OF ELEMENTS

10 Key Chain Attachment Means
15 Key Chain Attachment Means
20 Threaded Hole
25 Speaker
30 Circuit Boards
35 Button
40 Voice Chip
45 Supporting Post
50 Amplifier Signal Source
55 Internal Module
60 Batteries

What is claimed is:

1. A celebrity figurine comprising:

a. a front half shell housing and rear half shell housing, the front half presenting a front half of a celebrity body and rear half presenting a back of a celebrity body, wherein the front half shell housing and rear half shell housing are shaped to join together at an interface along the sides of the body, wherein a figurine showing a celebrity caricature is formed by the joining of the front half shell housing and rear half shell housing, b. an internal electronics module held between the front half shell housing and rear half shell housing holds a battery power supply, an electronic voice-recording chip, a speaker, and a push button assembly protruding outside the rear half shell, wherein the battery power supply provides electrical power for the electronic voice recording chip, and speaker, wherein the push button assembly activates a voice recording stored on the electronic voice recording chip and played on the speaker when the push button is pressed, wherein the internal electronics module comprises a mounted upper circuit board and a mounted lower circuit board, wherein the push button is mounted on the lower circuit board and protruding through the lower portion of the rear shell so that a user can press it to activate and play the voice recording, c. a supporting post built into the front shell protruding and supporting the lower circuit board so that a user pressing on the push button does not bias or move the lower circuit board.

2. A celebrity figurine comprising:

a. a front plastic shell housing and rear plastic shell housing, the front plastic shell housing painted to present a front half of a celebrity and a rear shell housing painted to present a back half of a celebrity, wherein the front plastic shell housing and rear plastic shell housing are formed to mate at an interface along the sides of the celebrity, wherein a complete figurine showing a celebrity character is formed by the joining of the front plastic shell housing and rear plastic shell housing, wherein the front plastic shell housing and rear plastic shell housing are hollow;

b. an internal circuit board sandwiched between the front plastic shell housing and rear-plastic shell housing holds a battery mount, an electronic voice-recording chip, a speaker, and a push button assembly having a button protruding through a hole in the rear plastic shell housing, wherein the battery power supply provides electrical power for the electronic voice recording chip, and speaker, wherein the push button assembly activates a voice recording stored on the electronic voice recording chip and played on the speaker when the push button is pressed, wherein the internal circuit board comprises a mounted upper circuit board and a mounted lower circuit board, wherein the push button is mounted on the lower circuit board and protruding through the lower portion of the rear shell so that a user can press it to activate and play the voice recording;

c. a supporting post built into the front shell protruding and supporting the lower circuit board so that a user pressing on the push button does not bias or move the lower circuit board.

* * * * *